US005868274A

United States Patent [19]

Lee

[11] Patent Number: 5,868,274

[45] Date of Patent: Feb. 9, 1999

[54] POWER SAVING APPARATUS OF AN AUTOMATIC VENDING MACHINE AND METHOD THEREOF

[75] Inventor: Hee-Soo Lee, Kwangju, Rep. of Korea

[73] Assignee: Kwangju Electronics Co., Ltd., Kwangju, Rep. of Korea

[21] Appl. No.: 883,270

[22] Filed: Jun. 26, 1997

[30] Foreign Application Priority Data

Jul. 13, 1996 [KR] Rep. of Korea ..... 96-20754
Mar. 3, 1997 [KR] Rep. of Korea ..... 97-6958

[51] Int. Cl.[6] ..... G07F 11/00

[52] U.S. Cl. ..... 221/13; 221/1

[58] Field of Search ..... 221/1, 2, 7, 9, 221/13, 15; 364/479.01, 479.06

[56] References Cited

U.S. PATENT DOCUMENTS 4,171,065 10/1979 Hurst ..... 221/7

*Primary Examiner*—Kenneth Noland
*Attorney, Agent, or Firm*—Merchant, Gould, Smith, Edell, Welter & Schmidt

[57] ABSTRACT

A power saving apparatus of an automatic vending machine and method thereof is provided to reduce an electric power consumed therein when it is not necessary as much power as a normal operating state of inner loads, such as a heater and a compressor, of the automatic vending machine. The power saving apparatus of the automatic vending machine includes a timer for counting time; a control part for generating a control signal for storing selling times of goods corresponding to each predetermined time counted by the timer and generating a control signal for reducing an operating time of inner loads of the automatic vending machine by comparing the selling times corresponding to a present time counted by the timer with a predetermined selling times; a memory for storing the selling times corresponding to each predetermined time counted by the timer; and a driving control part for controlling and driving an operation time of the inner loads of the automatic vending machine by a control signal from the control part.

2 Claims, 2 Drawing Sheets

POWER SAVING APPARATUS OF AN AUTOMATIC VENDING MACHINE AND METHOD THEREOF

BACKGROUND OF THE INVENTION

1. Field of the Invention

The present invention relates to an automatic vending machine and more particularly to a power saving apparatus of an automatic vending machine and method thereof for reducing an electric power consumed therein.

2. Description of the Prior Art

Generally, automatic vending machine have been widely used in countries. The automatic vending machines, such as coffee, cigarette, cake, and candy vending machines have goods safe-keeping chambers therein.

In these automatic vending machines, when coins are inserted by the user into the automatic vending machine and a selecting button is pushed to a predetermined goods, goods is extracted from an extract part of the automatic vending machine.

As shown in FIG. 1, a goods selecting apparatus of a conventional automatic vending machine includes a coin sensing mechanism 1 for generating a sensing signal according to a state of inserted coins and an amount of money to be inserted in the automatic vending machine, a goods selecting part 2 for selecting a predetermined article among goods stored or provided at the automatic vending machine, a control part 3 for displaying a selling possibility state of goods according to a sensing signal corresponding to the inserted coins and the amount of the money input from the coin sensing mechanism 1 and for generating a control signal to extract goods selected from the goods selecting part 2, a display part 4 for displaying the amount of inserted money and a selling possibility state of the automatic vending machine, and a goods extracting part 5 for extracting the selected goods according to an extract control signal from the control part 3.

Now, goods selecting operating process of the conventional automatic vending machine will be explained hereinafter.

When coins are inserted through a coin inserting slot (not shown) of the automatic vending machine by the user, condition of the coins or a bill and amount of money are sensed by a plurality of sensors(not shown) of the coin sensing mechanism 1 and a signal sensed therefrom is provided to the control part 3. The control part 3 generates a control signal for displaying a total inserted amount of money according to the sensing signal from the coin sensing mechanism 1 and also generates a control signal for displaying a state of goods selling possibility state in case the inserted money excess the selling price of the goods stored at the automatic vending machine.

After the state of the goods selling possibility shown in the display part 4 is confirmed, a selecting button is pushed by a user to be selected goods. A button signal corresponding to the goods selected from the goods selecting part 2 is provided to the control part 3. At this time, a control signal for extracting the selected goods is generated from the control part 3.

Accordingly, the user can obtain at any time a predetermined article among goods stored in the automatic vending machine, thus controlling and adjusting the extracting control signal from the control part 3.

However, if the conventional automatic vending machine is disposed at a place such as in an office limited time to be used an electric power is unnecessarily consumed even during non-use time because the electric power is kept supplying to several loads such as a heater for heating a goods or a compressor for cooling the goods.

SUMMARY OF THE INVENTION

An object of the present invention is to provide a power saving apparatus of a automatic vending machine and method thereof for reducing an electric power therein by controlling an operating time of each load of the automatic vending machine on the basis of amount of selling corresponding to each predetermined time.

In view of the object as mentioned above, a power saving apparatus of an automatic vending machine comprises:

a timer for counting time;

a control part for generating a control signal for storing selling times of goods corresponding to each predetermined time counted by the timer and generating a control signal for reducing an operating time of inner loads of the automatic vending machine by comparing the selling times corresponding to a present time counted by the timer with a predetermined selling times;

a memory for storing the selling times corresponding to each predetermined time counted by the timer; and a driving control part for controlling and driving an operation time of the inner loads of the automatic vending machine by a control signal from the control part.

According to the present invention, there is provided a power saving method of an automatic vending method comprising the steps of:

initializing the automatic vending machine and counting selling times during a predetermined period so as to store the selling times corresponding to each predetermined time counted by a timer;

comparing the selling time of goods corresponding to a present time counted by the timer with a predetermined selling times of goods after the predetermined period has passed;

driving inner loads of the automatic vending machine with a normal state when the selling times corresponding to the present time is more than the predetermined selling times; and reducing and driving an operating time of the inner loads of the automatic vending machine to a predetermined ratio when the selling times corresponding to the present time is less than the predetermined selling times.

DESCRIPTION OF THE PREFERRED EMBODIMENT

The present invention will now be described in detail with reference to the accompanying drawings.

Figure 1:
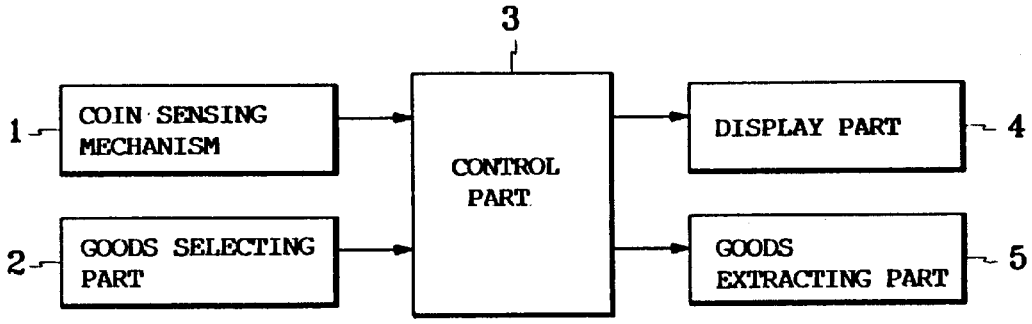
Fig. 1 (PRIOR ART)
FIG. 1 is a schematic block diagram of a conventional automatic vending machine.
Figure 2:
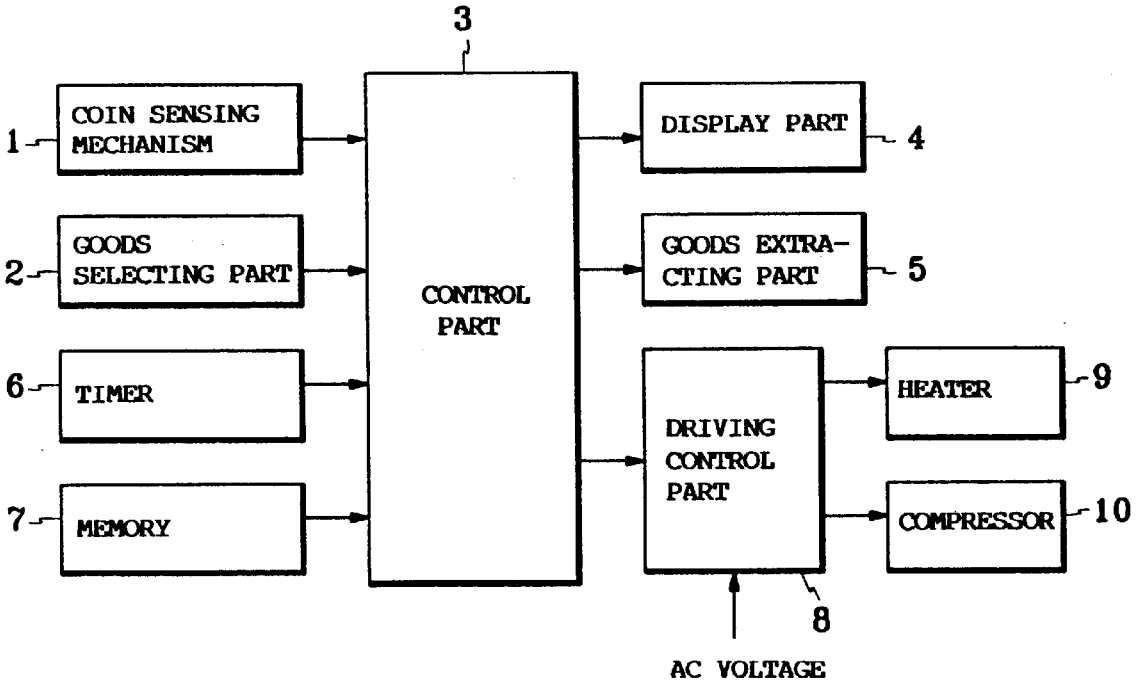
FIG.2 is a schematic block diagram of a power saving apparatus for an automatic vending machine according to a preferred embodiment of the present invention.

As shown in FIG. 2, a power saving apparatus of an automatic vending machine comprises a coin sensing mechanism 1, a goods selecting part 2, a control part 3, a display part 4, a goods extracting part 5, a timer 6, a memory 7, a driving control part 8, a heater 9 and a compressor 10.

The basic elements(for example, the coin sensing mechanism 1, the goods selecting part 2, the display part 4 and the goods extracting part 5) of the present invention are similarly constructed as those of the conventional automatic vending machine and description of the elements will be not described hereinafter.

In FIG. 2, a reference numeral 6 is a timer for counting a present time. At first, the present time counted by the timer 6 is input to the control part 3. The control part 3 generates a control signal for storing selling times of goods selected through the goods selecting part 2 corresponding to the present time counted by the timer 6 during a predetermined period (for example, two weeks) and also generates a control signal for driving a heater 9 and a compressor 10 by comparing selling times of goods at a predetermined time with a predetermined selling times (for example, twenty times) of goods after the predetermined period has passed.

The memory 7 stores the selling times corresponding to each predetermined time according to a control signal from the control part 3. The driving control part 8 controls the driving of the heater 9 and the compressor 10 according to a driving control signal from the control part 3.

Goods stored at a predetermined part of the automatic vending machine is maintained with a predetermined temperature by the driving of the heater 9 according to the driving control signal of the driving control part 8. Also, the compressor 10 keeps the goods cold by the driving control signal of the driving control part 8.

Now, a power saving method of an automatic vending machine according to the present invention will be described with the reference to FIGS. 2 and 3.

Figure 3:
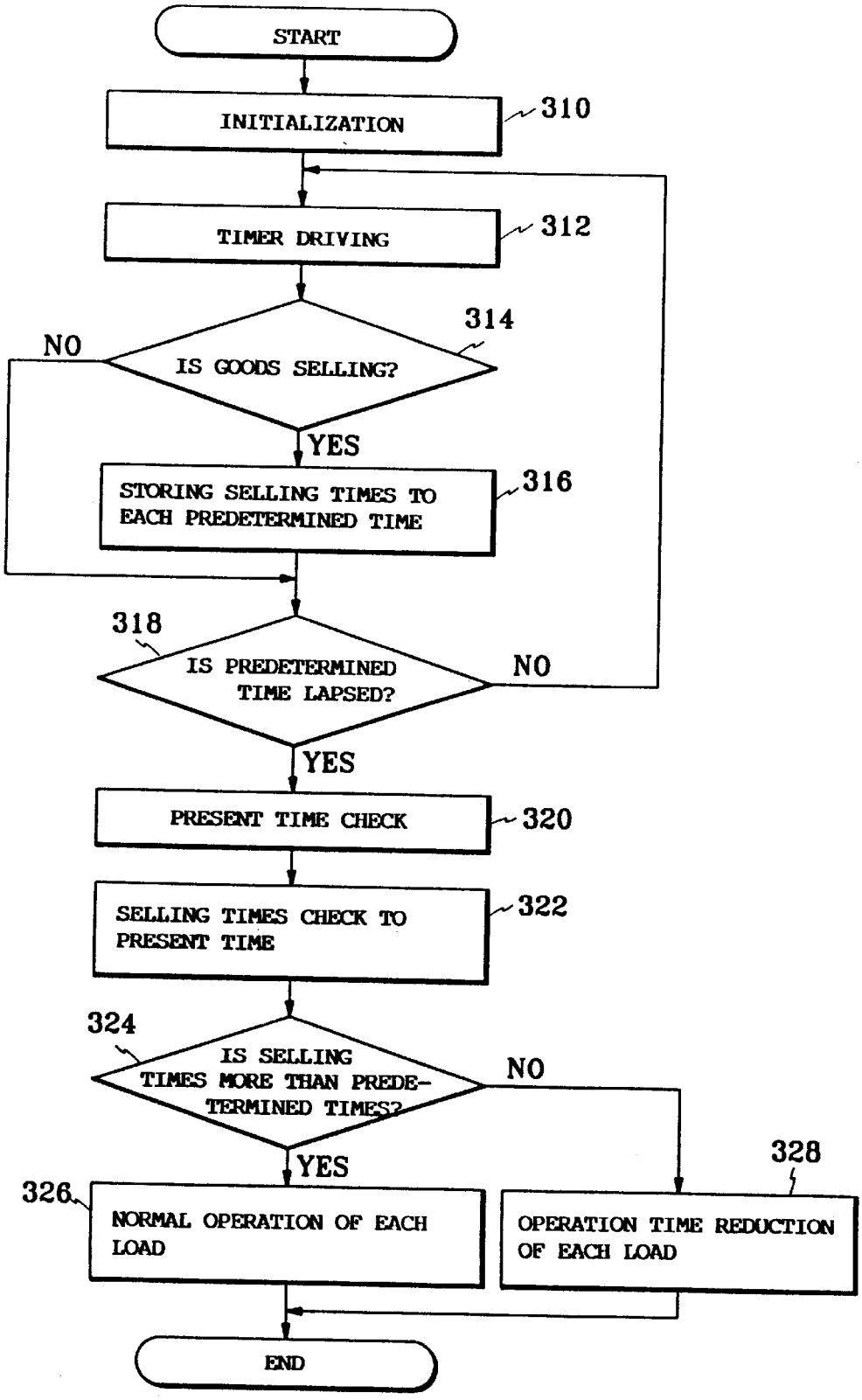
FIG.3 is a flow chart for explaining an AC voltage power saving operating process of a power saving method according to a preferred embodiment of the present invention.

As shown in FIG. 3, an AC voltage is provided from the outside to a power part(not shown) of the automatic vending machine, the automatic vending machine starts to initialize with predetermined input parameters by a control signal of the control part 3 at step 310.

After performing initialization at step 310, the control part 3 stores a data signal corresponding to a present time counted by the timer 6. That is, the present time is counted by the operating of the timer 6 at the step 312.

At step 314, the selling state of goods is determined by the control part 3 on the basis of a signal input from the goods selecting part 2. In case the goods is being sold, selling times is counted by a counter(not shown), the control part 3 generates a control signal for storing selling times corresponding to a present time counted by the timer 6. At step 316, according to a control signal of the control port 3 the selling times corresponding to the present time is stored at the memory 7.

The control part 3 compares a predetermined period (for example, two weeks) with the present time counted by the timer at step 318. As a result of comparison, when it is determined that the present time is shorter than the predetermined period, the procedure returns to step 312 to repeatedly execute steps 314, 316. If the counted time by the timer 6 is longer than the predetermined period, the control part 3 determines a present time being counted by the timer 6 at step 320.

At step 322, the control part 3 determines the selling times corresponding to the present time counted by the timer 6 at step 320 from the memory 7 and compares the selling times corresponding to the present time with the predetermined times (for example, 20) at step 324.

As a result of comparison at step 324, if it is determined that the selling times is more than the predetermined times (in case of YES), the control part 3 generates a control signal to normally drive the heater 9 and the compressor 10 and outputs to the driving control part 8. Accordingly, at step 326 the driving control part 8 drives the heater 9 and the compressor 10 normally.

Accordingly, the goods provided at the automatic vending machine is kept to a predetermined heating temperature by the driving of the heater 9, and is kept to a predetermined cooling temperature by the driving of the compressor 10.

Meanwhile, as the result of comparison at step 324, if it is determined that the selling times is less than the predetermined times, the control part 3 generates a control signal for reducing the operation time of the loads (for example, the heater 9 and the compressor 10) to a predetermined ratio and output to the driving control part 8 at step 328.

Accordingly, the driving control part 8 drives the heater 9 and the compressor 10 for the reduced operating time to keep the goods predetermined heating or cooling temperature.

Although the preferred embodiment of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A power saving apparatus for an automatic vending machine comprising:

a timer for counting time;

a control part for generating a control signal for storing selling times of goods corresponding to each predetermined time counted by the timer and generating a control signal for reducing an operating time of inner loads of the automatic vending machine by comparing the selling times corresponding to a present time counted by the timer with a predetermined selling times;

a memory for storing the selling times corresponding to each predetermined time counted by the timer; and a driving control part for controlling and driving an operation time of the inner loads of the automatic vending machine by a control signal from the control part.

2. A power saving method for an automatic vending method comprising the steps of:

initializing the automatic vending machine and counting selling times during a predetermined period so as to store the selling times corresponding to each predetermined time counted by a timer;

comparing the selling times of goods corresponding to a present time counted by the timer with a predetermined selling times of goods after the predetermined period has passed;

driving inner loads of the automatic vending machine with a normal state when the selling times corresponding to the present time is more than the predetermined selling times; and reducing and driving an operating time of the inner loads of the automatic vending machine to a predetermined ratio when the selling times corresponding to the present time is less than the predetermined selling times.

* * * * *